US010775718B2

(12) United States Patent
Mizuno

(10) Patent No.: US 10,775,718 B2
(45) Date of Patent: Sep. 15, 2020

(54) POWER TRANSMISSION MECHANISM AND IMAGE FORMING APPARATUS

(71) Applicant: KYOCERA Document Solutions Inc., Osaka-shi, Osaka (JP)

(72) Inventor: Masahiko Mizuno, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/738,218

(22) Filed: Jan. 9, 2020

(65) Prior Publication Data

US 2020/0233341 A1 Jul. 23, 2020

(30) Foreign Application Priority Data

Jan. 18, 2019 (JP) ..... 2019-006531

(51) Int. Cl.
*G03G 21/00* (2006.01)
*G03G 15/16* (2006.01)
*G03G 15/08* (2006.01)

(52) U.S. Cl.
CPC ..... *G03G 15/1615* (2013.01); *G03G 15/0896* (2013.01); *G03G 2221/1657* (2013.01)

(58) Field of Classification Search
CPC ..... G03G 15/0896; G03G 15/1615; G03G 2221/1657
See application file for complete search history.

(56) References Cited

U.S. PATENT DOCUMENTS

2017/0131662 A1* 5/2017 Iwakoshi ..... F16H 1/206
2017/0285519 A1* 10/2017 Mizuno ..... G03G 21/1857

FOREIGN PATENT DOCUMENTS

JP 2008151192 A 7/2008

* cited by examiner

*Primary Examiner* — Hoang X Ngo
(74) *Attorney, Agent, or Firm* — Alleman Hall Creasman & Tuttle LLP

(57) ABSTRACT

A power transmission mechanism includes a driving gear and a driven gear. The driving gear includes a teeth portion and a tooth-chipped portion. The driven gear is intermittently driven transitioning between a meshing state and a non-meshing state. An interval between a first tooth and a second tooth of the driven gear is wider than an interval between teeth of the driven gear that are, starting with the second tooth, on an upstream side of the first tooth in a rotation direction of the driven gear. When the non-meshing state transitions to the meshing state, the first tooth abuts on a tooth of the driving gear that is, in the teeth portion, on a most downstream side in a rotation direction of the driving gear, and the second tooth is the $2^{nd}$ tooth counted from the first tooth toward the upstream side in the rotation direction.

8 Claims, 11 Drawing Sheets

POWER TRANSMISSION MECHANISM AND IMAGE FORMING APPARATUS

INCORPORATION BY REFERENCE

This application is based upon and claims the benefit of priority from the corresponding Japanese Patent Application No. 2019-006531 filed on Jan. 18, 2019, the entire contents of which are incorporated herein by reference.

BACKGROUND

The present disclosure relates to a power transmission mechanism and an image forming apparatus.

There is known a power transmission mechanism in which a tooth is provided on an outer circumference of a flexible portion formed on a tooth-chipped gear so as to restrict the gears from being stopped or broken due to collision between tips of the gear teeth.

SUMMARY

A power transmission mechanism according to an aspect of the present disclosure includes a driving gear and a driven gear. The driving gear includes a teeth portion and a tooth-chipped portion, wherein in the teeth portion, a plurality of teeth are formed along a circumferential direction of the driving gear, and in the tooth chipped portion, no tooth is formed. The driven gear is intermittently driven transitioning between a meshing state and a non-meshing state as the driving gear rotates, wherein in the meshing state, the driven gear and the driving gear mesh with each other, and in the non-meshing state, the driving gear and the driven gear do not mesh with each other. An interval between a first tooth and a second tooth of the driven gear is wider than an interval between teeth of the driven gear that are, starting with the second tooth, on an upstream side of the first tooth in a rotation direction of the driven gear, wherein the first tooth is a tooth of the driven gear that, when the non-meshing state transitions to the meshing state, abuts on a tooth of the driving gear that is, in the teeth portion, on a most downstream side in a rotation direction of the driving gear, and the second tooth is the $2^{nd}$ tooth counted from the first tooth toward the upstream side in the rotation direction.

An image forming apparatus according to another aspect of the present disclosure includes a developing device, a toner supply portion, a motor, and the power transmission mechanism. The toner supply portion supplies toner to the developing device. The power transmission mechanism transmits a power of the motor to the toner supply portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure. It is noted that, for the sake of explanation, a vertical direction in a state where an image forming apparatus 10 is usably installed (the state shown in FIG. 1), is defined as an up-down direction D1. In addition, a front-rear direction D2 and a left-right direction D3 are defined in the state where the image forming apparatus 10 is usably installed.

The image forming apparatus 10 according to the present embodiment has at least a print function. The image forming apparatus 10 is, for example, a tandem-type color printer.

Figure 1:
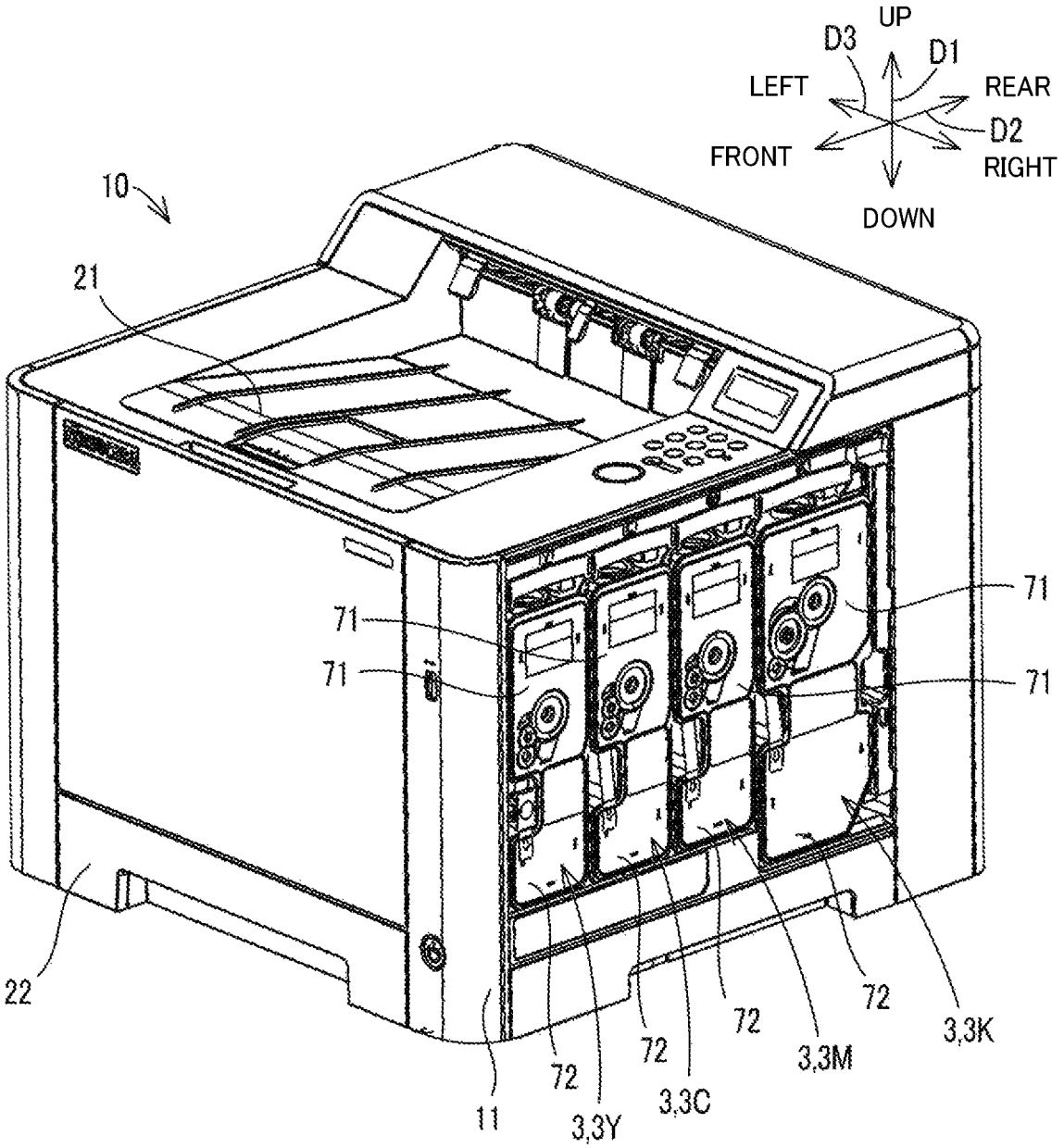
FIG. 1 is a perspective diagram showing a configuration of an image forming apparatus according to an embodiment of the present disclosure.
Figure 2:
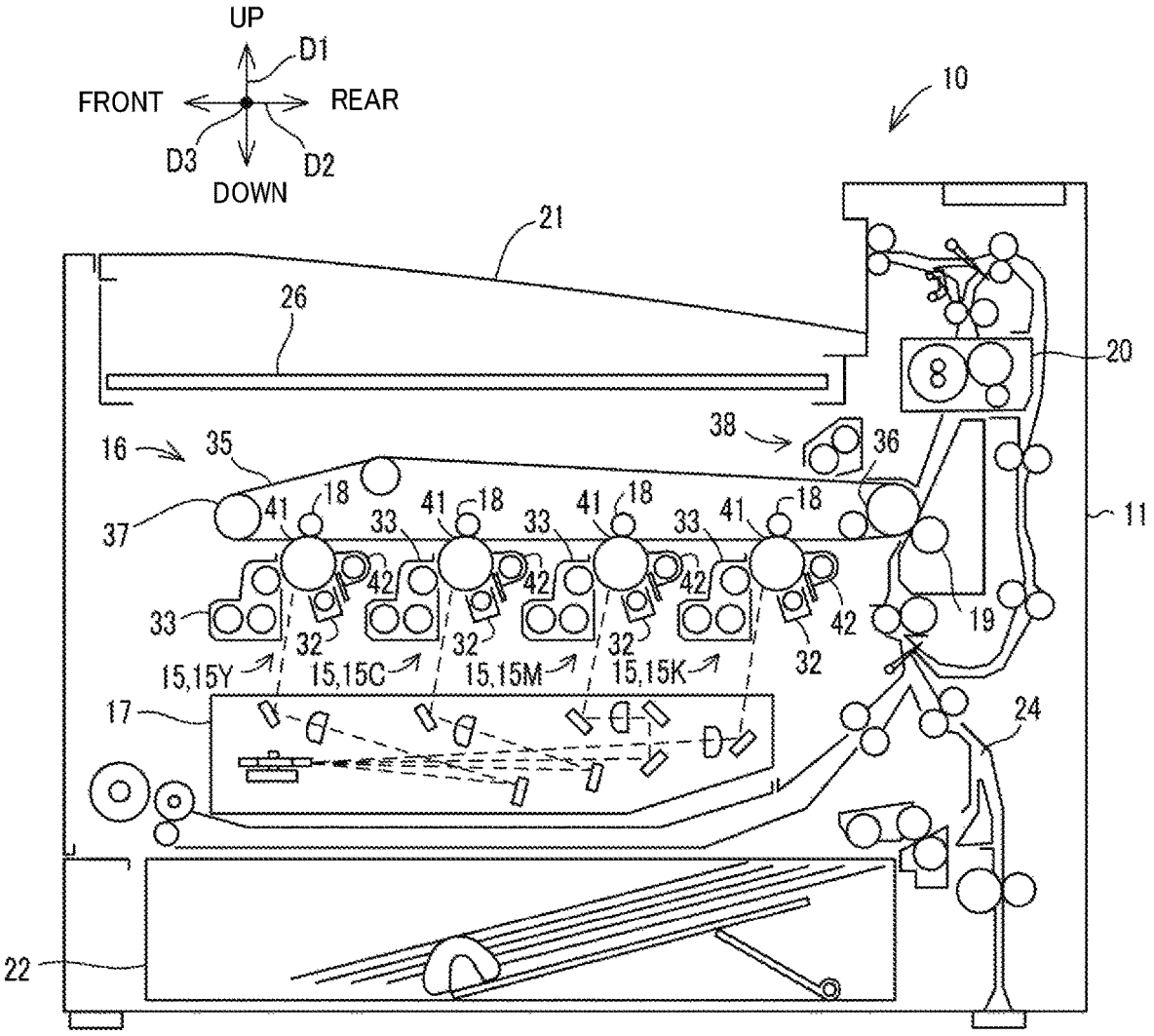
FIG. 2 is a cross-sectional diagram showing a configuration of the image forming apparatus according to the embodiment of the present disclosure.

As shown in FIG. 1 and FIG. 2, the image forming apparatus 10 includes a housing 11. Some of the components constituting the image forming apparatus 10 are stored in the housing 11. It is noted that FIG. 1 shows a state where a right side cover of the storage portion 11 is removed.

As shown in FIG. 2, the image forming apparatus 10 includes a plurality of image forming units 15 (15Y, 15C, 15M, and 15K), an intermediate transfer unit 16, a laser scanning unit 17, a primary transfer roller 18, a secondary transfer roller 19, a fixing device 20, a sheet tray 21, a sheet feed cassette 22, a conveyance path 24, and a control board 26 configured to control the components of the image forming apparatus 10. In addition, as shown in FIG. 1, the image forming apparatus 10 includes a plurality of toner containers 3 (3Y, 3C, 3M, and 3K) attached to the inside of the housing 11 in a detachable manner.

As shown in FIG. 2, the image forming units 15 are arranged in alignment along the front-rear direction D2 in the housing 11, and form a color image based on what is called a tandem system. Specifically, the image forming unit 15Y is configured to form a toner image of yellow, and the image forming units 15C, 15M and 15K form toner images of cyan, magenta and black, respectively.

The image forming units 15 form toner images by an electrophotographic method. Each of the image forming units 15 includes a photoconductor drum 41, a drum cleaning device 42, a charging device 32, and a developing device 33.

As shown in FIG. 1, each of the toner containers 3 includes an upper storage portion 71 and a lower storage portion 72. The upper storage portion 71 includes, inside thereof, a storage space storing unused toner for supply. The lower storage portion 72 includes, inside thereof, a storage space for storing waste toner discharged from the drum cleaning device 42. In the state where the toner containers 3 are attached to the housing 11, the unused toner is supplied to the inside of the developing devices 33 from the upper storage portions 71 of the toner containers 3. In addition, the waste toner discharged from the drum cleaning devices 42 passes through discharge guide portions (not shown), and is guided to and stored in the lower storage portions 72 of the toner containers 3.

As shown in FIG. 2, the intermediate transfer unit 16 is provided above the four image forming units 15. More specifically, the intermediate transfer unit 16 is provided above the photoconductor drums 41. The intermediate transfer unit 16 includes a transfer belt 35 of an annular shape, a driving roller 36, a driven roller 37, and a belt cleaning device 38.

Figure 3:
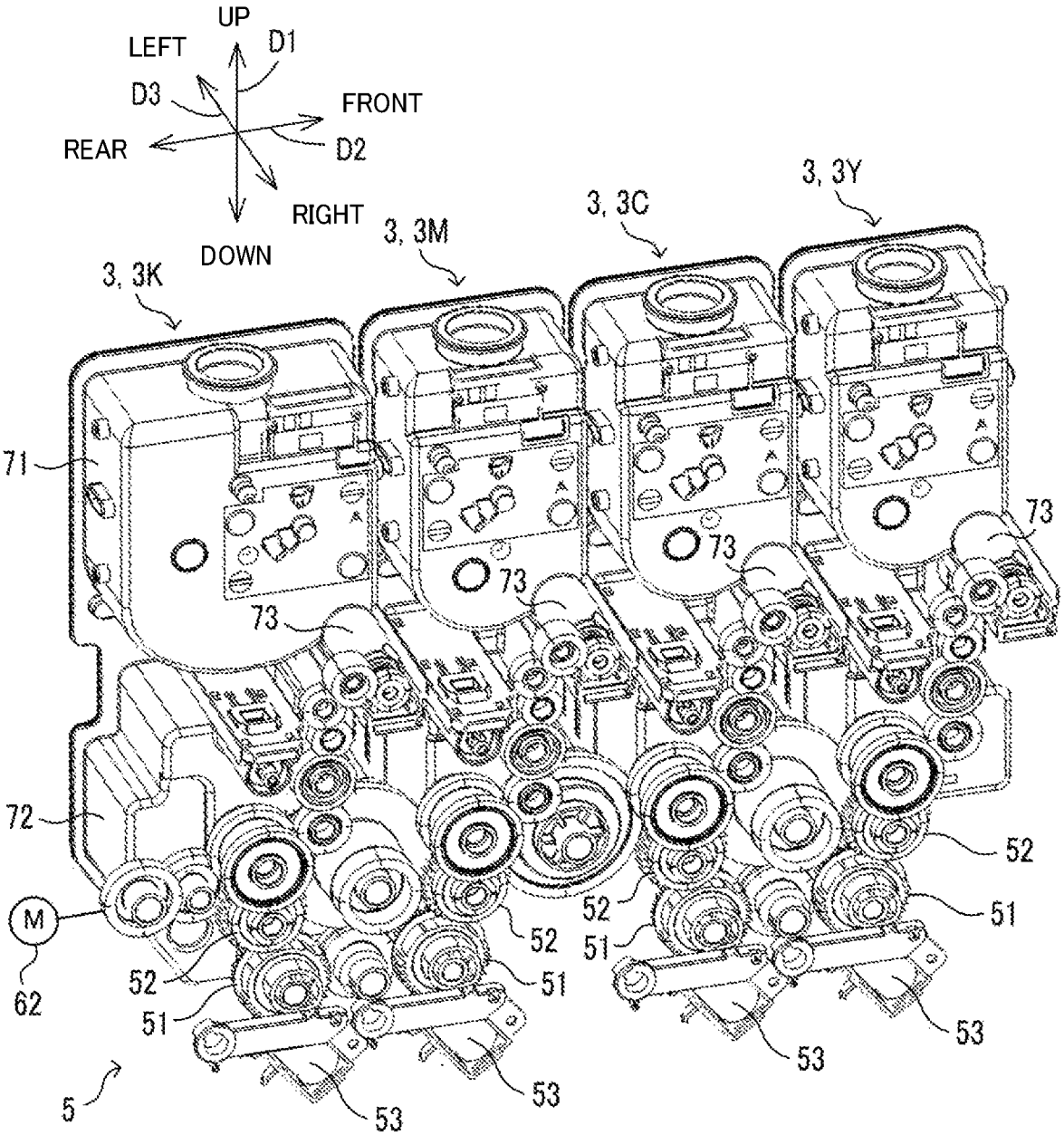
FIG. 3 is a perspective diagram showing a configuration of a power transmission mechanism of the image forming apparatus according to the embodiment of the present disclosure.

As shown in FIG. 3, the image forming apparatus 10 includes, in correspondence with the toner containers 3, toner supply portions 61 that are configured to supply the toner stored in the upper storage portions 71 of the toner containers 3 to the developing device 33. In addition, the image forming apparatus 10 includes a power transmission mechanism 5 configured to transmit a power from a motor 62 to the toner supply portions 61.

Each of the toner supply portions 61 includes a screw-type conveyance member that is rotationally driven by a power transmitted by the power transmission mechanism 5. As the screw-type conveyance member rotates, toner is conveyed from the upper storage portion 71 of the toner container 3 to the developing device 33.

The power transmission mechanism 5 includes a plurality of gears for transmitting the power of the motor 62 to the toner supply portion 61. Specifically, the power transmission mechanism 5 includes a driving gear 51 and a driven gear 52 for each of the toner supply portions 61. In addition, the power transmission mechanism 5 includes actuators 53 in correspondence with the driving gears 51, wherein each of the actuators 53 controls the rotation of a corresponding driving gear 51 in units of circumferences. Each of the actuators 53 includes an engaging portion 531 (see FIG. 4) that swings in an approaching/separating direction D4 shown in FIG. 4, in response to an input control signal.

[Configuration of Driving Gear]

Figure 4:
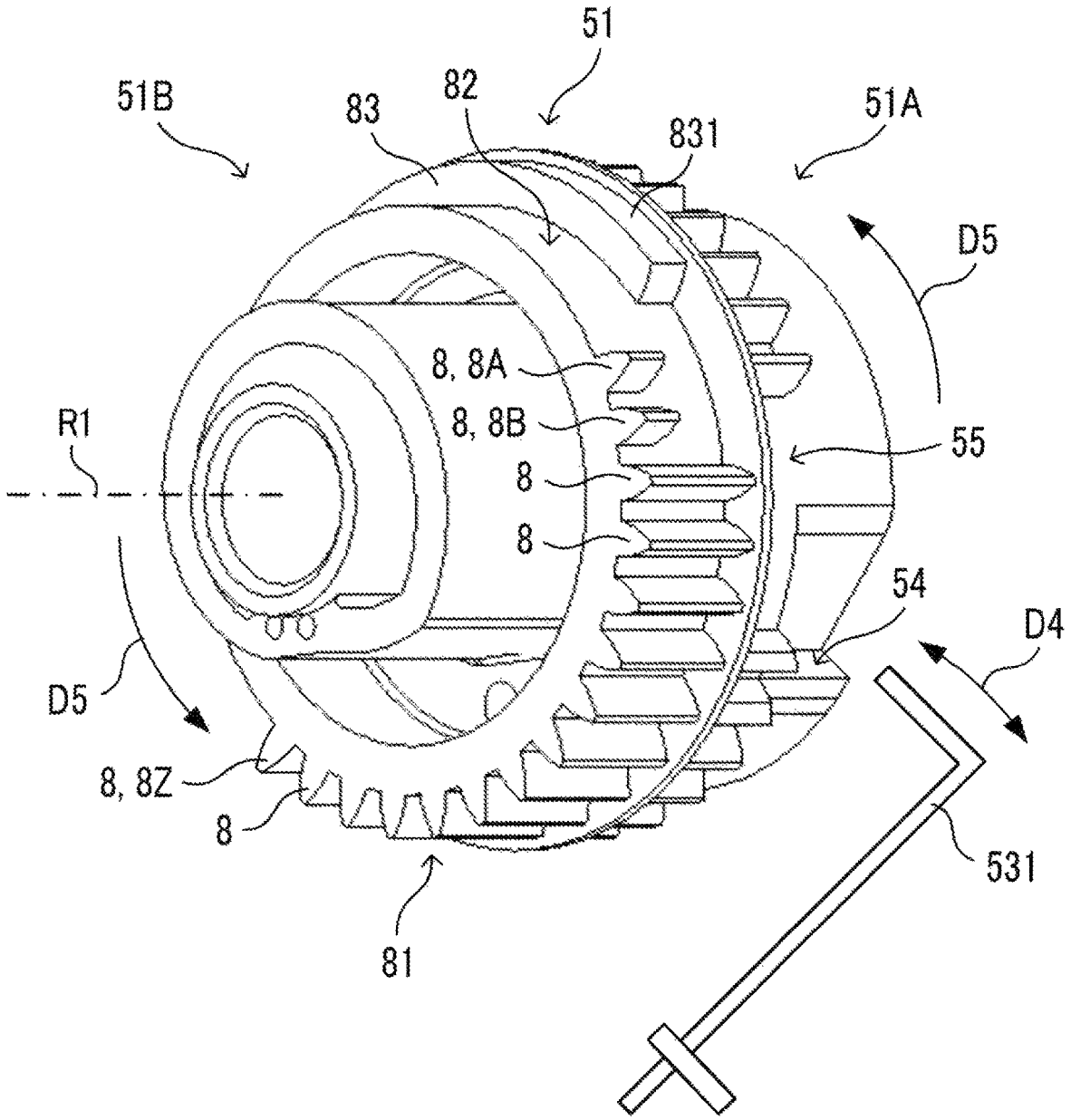
FIG. 4 is a perspective diagram showing a configuration of a driving gear of the image forming apparatus according to the embodiment of the present disclosure.

As shown in FIG. 4, each of the driving gears 51 is supported in such a way as to rotate around a rotation shaft R1, and includes an input gear portion 51A and an output gear portion 51B. The driving gear 51 receives a power from another gear (not shown, hereinafter referred to as an input-side gear) via the input gear portion 51A, and transmits the power to the driven gear 52 via the output gear portion 51B.

The input gear portion 51A includes a stepped portion 54 and a tooth-chipped portion 55 that constitute a clutch mechanism for controlling the rotation of the driving gear 51 in units of circumferences. In response to the rotation of the input-side gear, the driving gear 51 rotates in a rotation direction D5 shown in FIG. 4. When the tooth-chipped portion 55 reaches a position that faces the input-side gear, a non-meshing state occurs where the input-side gear and the driving gear 51 do not mesh with each other. At this time, although the driving gear 51 is biased in the rotation direction D5 by a biasing member (not shown), the engaging portion 531 of the actuator 53 abuts on the stepped portion 54, and the rotation of the driving gear 51 is restricted. Subsequently, when a control signal is input, the engaging portion 531 of the actuator 53 separates from the stepped portion 54. Then the driving gear 51 is rotated in the rotation direction D5 by the biasing force of the biasing member, and a meshing state occurs where the input-side gear and the driving gear 51 mesh with each other. Thereafter, the driving gear 51 rotates in the rotation direction D5 until the engaging portion 531 of the actuator 53 abuts on the stepped portion 54 again. In this way, the rotation of the driving gear 51 is controlled in units of circumferences by the control signal.

The output gear portion 51B includes a teeth portion 81 and a tooth-chipped portion 82, wherein in the teeth portion 81, a plurality of teeth 8 are formed along a circumferential direction of the driving gear 51, and in the tooth chipped portion 82, the teeth 8 are not formed. It is noted that among the plurality of teeth 8 formed in the teeth portion 81, a tooth 8 located on the most downstream side in the rotation direction D5 may be referred to as a "tooth 8A", and the $2^{nd}$ tooth 8 counted from the tooth 8A toward the downstream side in the rotation direction D5 may be referred to as a "tooth 8B". In addition, among the plurality of teeth 8 formed in the teeth portion 81, a tooth 8 located on the most upstream side in the rotation direction D5 may be referred to as a "tooth 8Z". It is noted that some of the plurality of teeth 8 formed in the teeth portion 81 (specifically, at least the teeth 8A, 8B, and 8Z) are shorter in width in the axial direction along the rotation shaft R1, than the other teeth 8. This is to avoid an interference with facing ribs 91 formed on the driven gear 52, the facing ribs 91 being described below.

The driving gear 51 includes an annular rib 83 formed along the tooth-chipped portion 82. The annular rib 83 includes an outer circumferential surface 831 having a shape of a circular arc centering on the rotation shaft R1 of the driving gear 51. The annular rib 83 has a function to fix the position of the facing ribs 91 (see FIG. 5A and FIG. 5B) in a non-meshing state where the driving gear 51 and the driven gear 52 do not mesh with each other, the facing ribs 91 being provided in the driven gear 52 and described below.

[Configuration of Driven Gear]

Figure 5A:
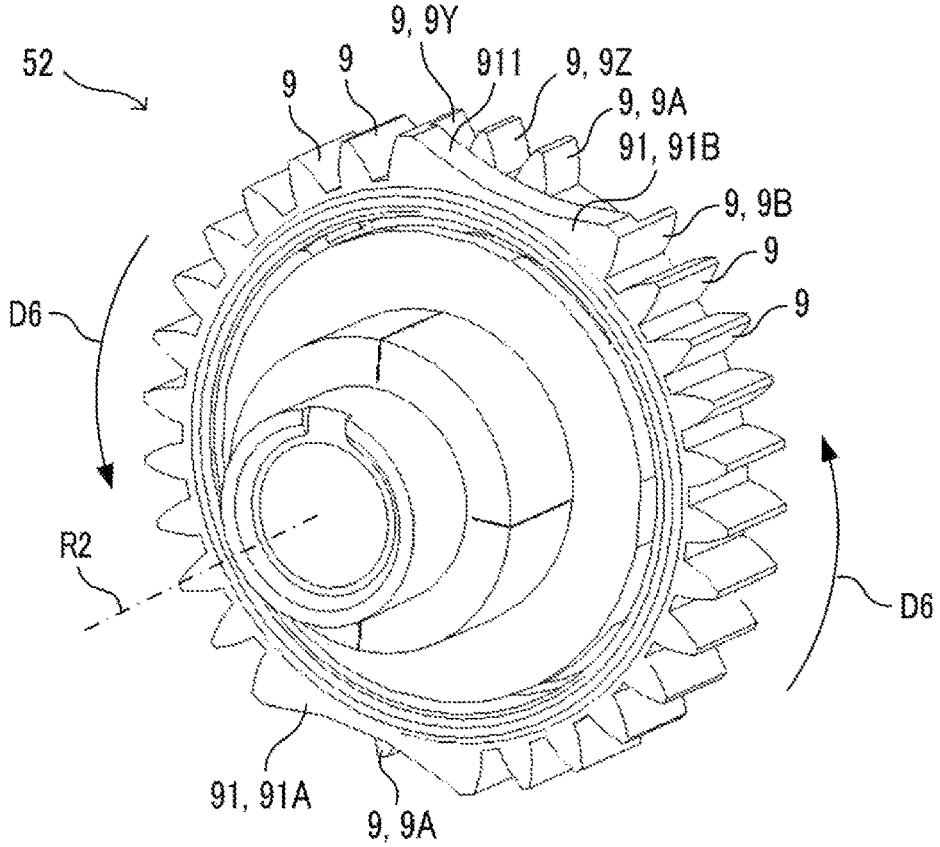
FIG. 5A and FIG. 5B are perspective diagrams showing a configuration of a driven gear of the image forming apparatus according to the embodiment of the present disclosure.
Figure 5B:
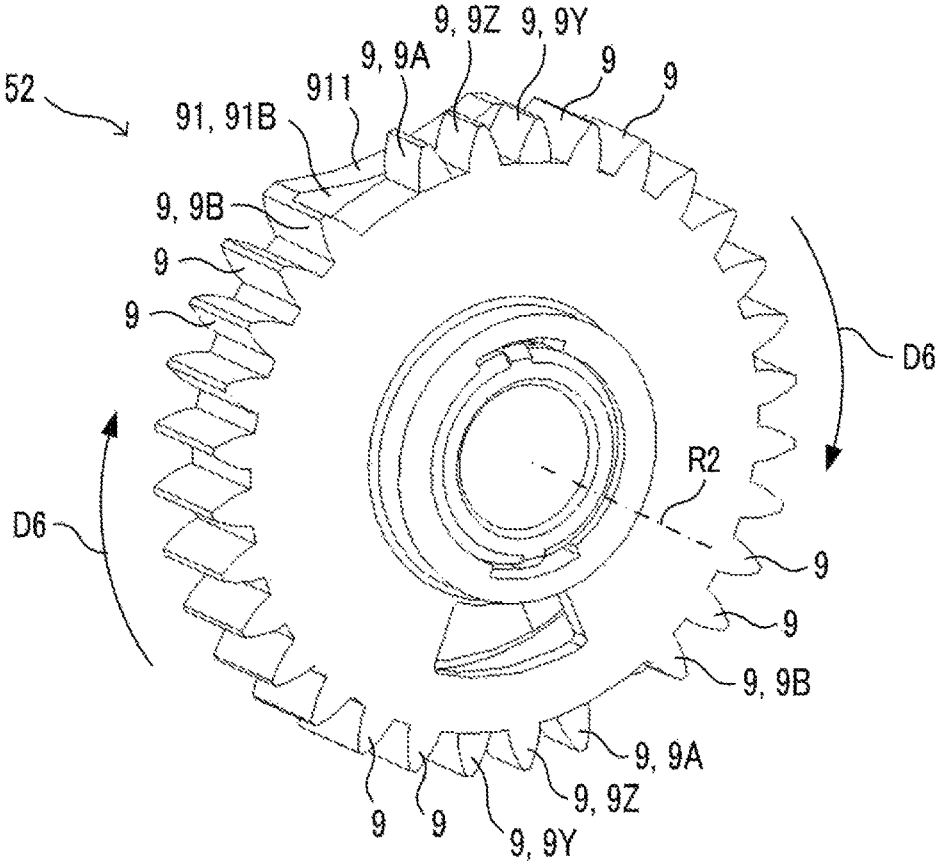

As shown in FIG. 5A and FIG. 5B, each of the driven gears 52 is supported in such a way as to rotate around a rotation shaft R2. The driven gear 52 is intermittently driven transitioning between a meshing state and the non-meshing state as the driving gear 51 rotates, wherein in the meshing state, the driven gear 52 and the driving gear 51 mesh with each other, and in the non-meshing state, the driving gear 51 and the driven gear 52 do not mesh with each other. In the meshing state, the driven gear 52 rotates in a rotation direction D6 shown in FIG. 5A and FIG. 5B with the rotation of the driving gear 51. This allows the power of the motor 62 (see FIG. 3) to be transmitted from the driving gear 51 to the driven gear 52, and transmitted finally to the toner supply portion 61. On the other hand, in the non-meshing state, the driven gear 52 does not rotate while the driving gear 51 rotates, and the power of the motor 62 (see FIG. 3) is not transmitted from the driving gear 51 to the driven gear 52.

On the driven gear 52, a plurality of teeth 9 are formed along a circumferential direction of the driven gear 52. In addition, on the driven gear 52, two facing ribs 91 (specifically, a facing rib 91A and a facing rib 91B) are formed at equal intervals along the circumferential direction of the driven gear 52. It is noted that hereinafter, one of the two facing ribs 91 may be referred to as the "facing rib 91A" and the other may be referred to as the "facing rib 91B".

Figure 6A:
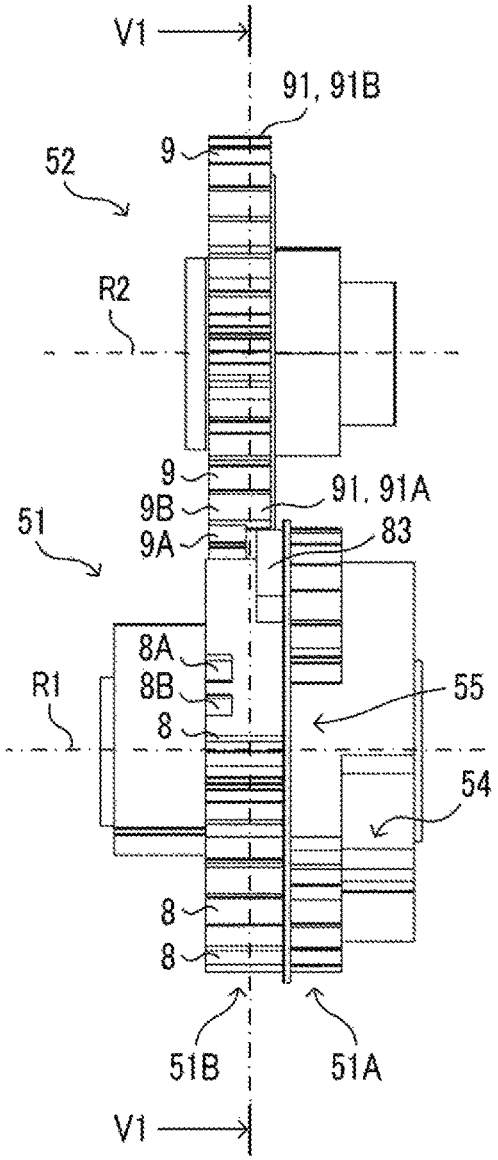
FIG. 6A and FIG. 6B are cross-sectional diagrams of the driving gear and the driven gear of the image forming apparatus according to the embodiment of the present disclosure.
Figure 6B:
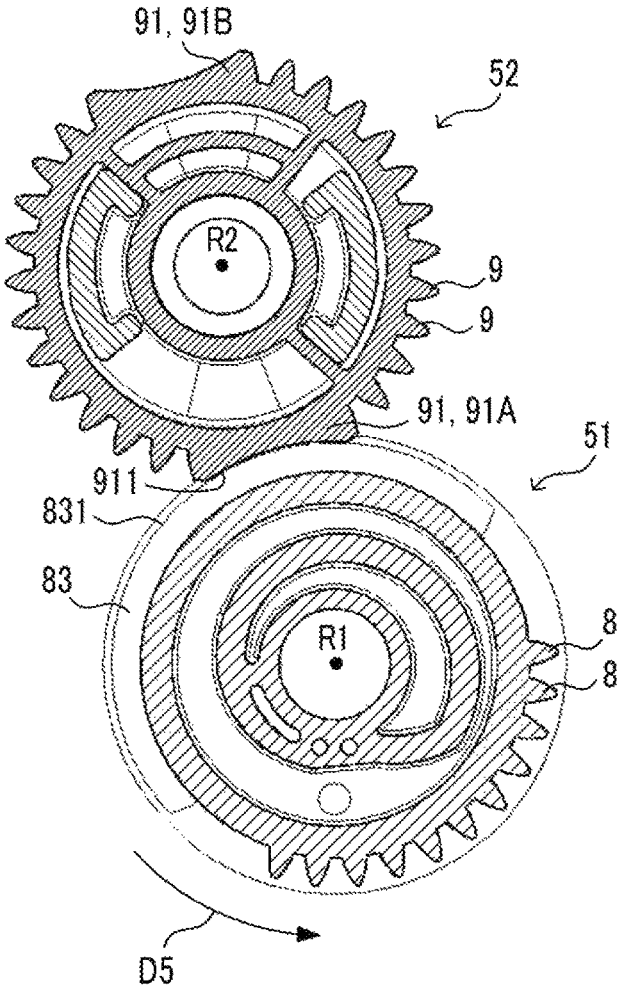
Figure 7A:
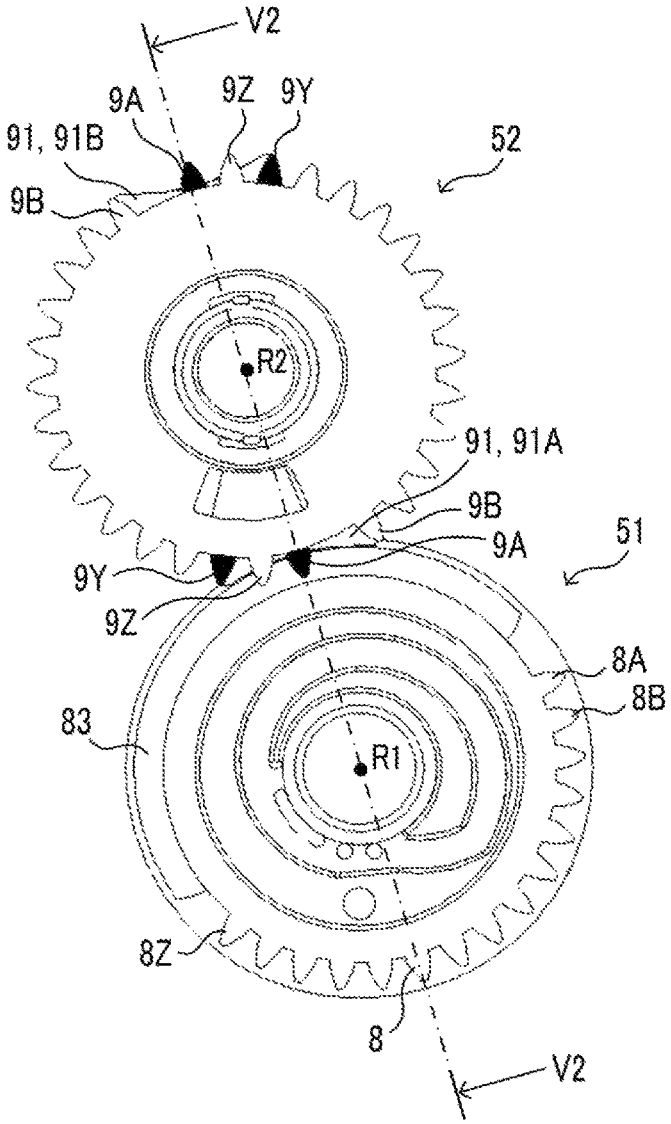
FIG. 7A and FIG. 7B are cross-sectional diagrams of the driving gear and the driven gear of the image forming apparatus according to the embodiment of the present disclosure.
Figure 7B:
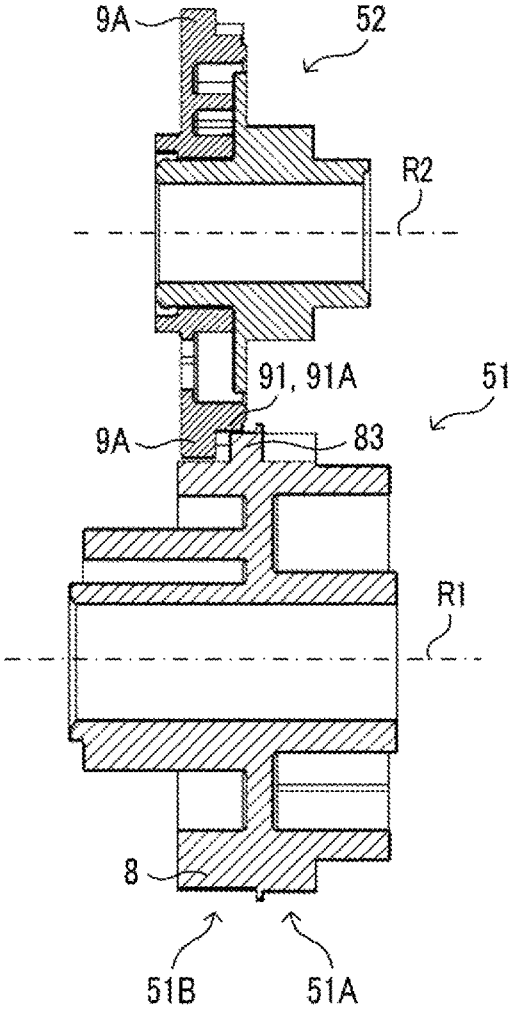

FIG. 6A shows the driving gear 51 and the driven gear 52 in the non-meshing state viewed in a direction perpendicular to the rotation shaft R1 and the rotation shaft R2. FIG. 6B is a cross-sectional diagram of the driving gear 51 and the driven gear 52 taken along a V1-V1 line and viewed from the direction of arrows of FIG. 6A. FIG. 7A shows the driving gear 51 and the driven gear 52 in the non-meshing state viewed in a direction extending along the rotation shaft R1 and the rotation shaft R2. FIG. 7B is a cross-sectional diagram of the driving gear 51 and the driven gear 52 taken along a V2-V2 line and viewed from the direction of arrows of FIG. 7A.

As shown in FIG. 6B, each of the facing ribs 91 includes an outer circumferential surface 911 that has a shape along the outer circumferential surface 831 of the annular rib 83 in the non-meshing state. In addition, as shown in FIG. 7B, in the non-meshing state, a facing rib 91 and the annular rib 83 partially abut on each other, or face each other with a slight gap therebetween. In the non-meshing state, the annular rib 83 fixes the position of facing ribs 91. This restricts the rotation of the driven gear 52. That is, the annular rib 83 and the facing ribs 91 function as a rotation restricting mechanism that restricts the rotation of the driven gear 52 in the non-meshing state. It is noted that another mechanism may be adopted as the rotation restricting mechanism.

In the meshing state (namely, in a state where the teeth portion 81 of the driving gear 51 faces the driven gear 52), the driven gear 52 rotates in response to the rotation of the driving gear 51. On the other hand, in the non-meshing state (namely, in a state where the tooth-chipped portion 82 of the driving gear 51 faces the driven gear 52), the driving gear 51 rotates, but the driven gear 52 comes to a stationary state. In this way, the driven gear 52 is intermittently driven transitioning between the meshing state and the non-meshing state as the driving gear 51 rotates.

Meanwhile, as a technology related to the power transmission mechanism 5 of the present embodiment, there is known a power transmission mechanism in which a tooth is provided on an outer circumference of a flexible portion formed in a tooth-chipped gear so as to restrict the gears from being stopped or broken due to collision between tips of the gear teeth. However, the power transmission mechanism of the related technology is not configured to prevent an occurrence of collision between tips of the gear teeth, and thus a collision noise occurs when tips of gear teeth collide with each other. In addition, when tips of gear teeth collide with each other, a large force acts in a direction from a contact point of the tips toward the rotation shaft of the gear. This causes the gear to collide with a bearing that supports the gear, allowing a collision noise to occur. On the other hand, according to the power transmission mechanism 5 of the present embodiment, it is possible to restrict the gears from generating a noise.

In the power transmission mechanism 5 of the present embodiment, an interval between a tooth 9A and a tooth 9B is wider than an interval between teeth 9 that are, starting with the tooth 9B, on the upstream side of the tooth 9A in the rotation direction D6, wherein the tooth 9A is a tooth 9 of the driven gear 52 that abuts on the tooth 8A of the driving gear 51 when the non-meshing state transitions to the meshing state (namely, at the timing shown in FIG. 8B), and the tooth 9B is the $2^{nd}$ tooth 9 counted from the tooth 9A toward the upstream side in the rotation direction D6. The tooth 9A is an example of a "first tooth" of the present disclosure, and the tooth 9B is an example of a "second tooth" of the present disclosure.

It is noted that among the plurality of teeth 9 formed on the driven gear 52, the $2^{nd}$ tooth 9 counted from the tooth 9A toward the downstream side in the rotation direction D6 may be referred to as a "tooth 9Z", and the $3^{rd}$ tooth 9 counted from the tooth 9A toward the downstream side in the rotation direction D6 may be referred to as a "tooth 9Y". As shown in FIG. 5A and FIG. 5B, the outer circumferential surface 911 of the facing rib 91 is formed to extend from the tip of the tooth 9B to the tip of the tooth 9Y. This enhances the strength of the facing ribs 91, or the strength of the tooth 9B and the tooth 9Y.

As shown in FIG. 7A, the teeth 9A of the driven gear 52 are formed at positions that, in the non-meshing state, intersect a plane that includes the rotation shaft R1 of the driving gear 51 and the rotation shaft R2 of the driven gear 52. In addition, in the non-meshing state, the teeth 9B of the driven gear 52 are located outside the tooth tip circle of the driving gear 51. As a result, when the non-meshing state transitions to the meshing state, the tooth 8A of the driving gear 51 abuts on the tooth 9A of the driven gear 52, without abutting on the tooth 9B of the driven gear 52.

The following describes how the driven gear 52 moves during a single rotation of the driving gear 51 with reference to FIG. 8A to FIG. 10B.

Figure 8B:
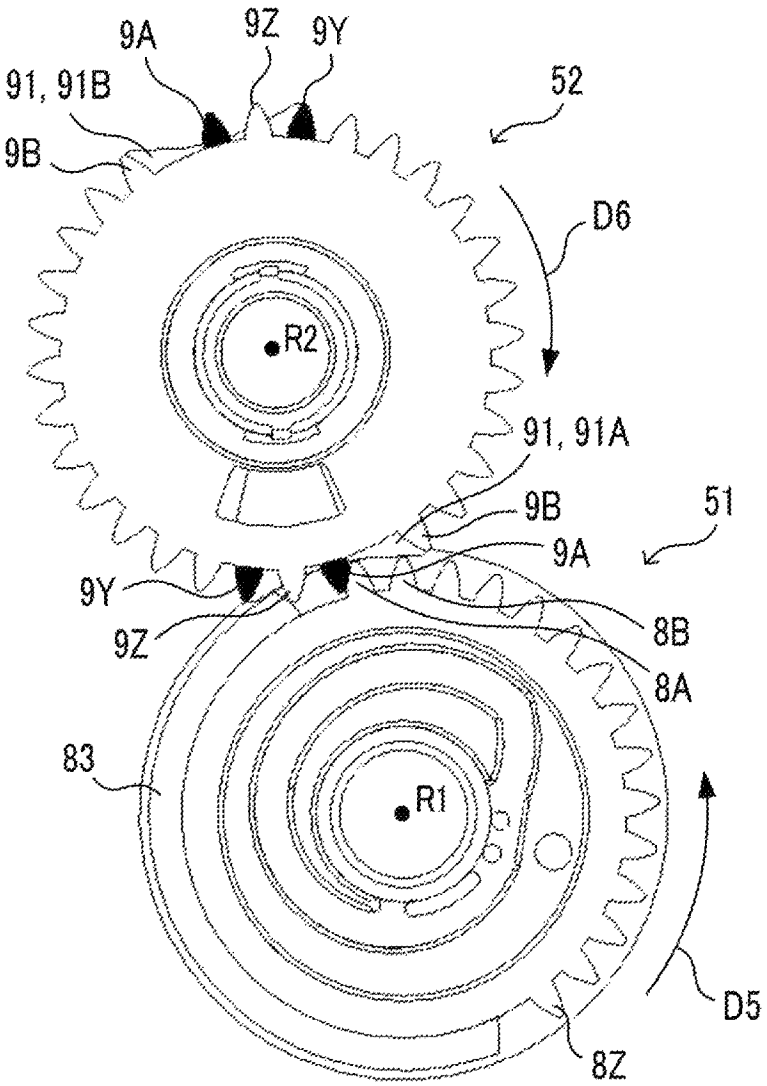
FIG. 8A and FIG. 8B are diagrams showing movement of the driving gear and the driven gear in the image forming apparatus according to the embodiment of the present disclosure.
Figure 8A:
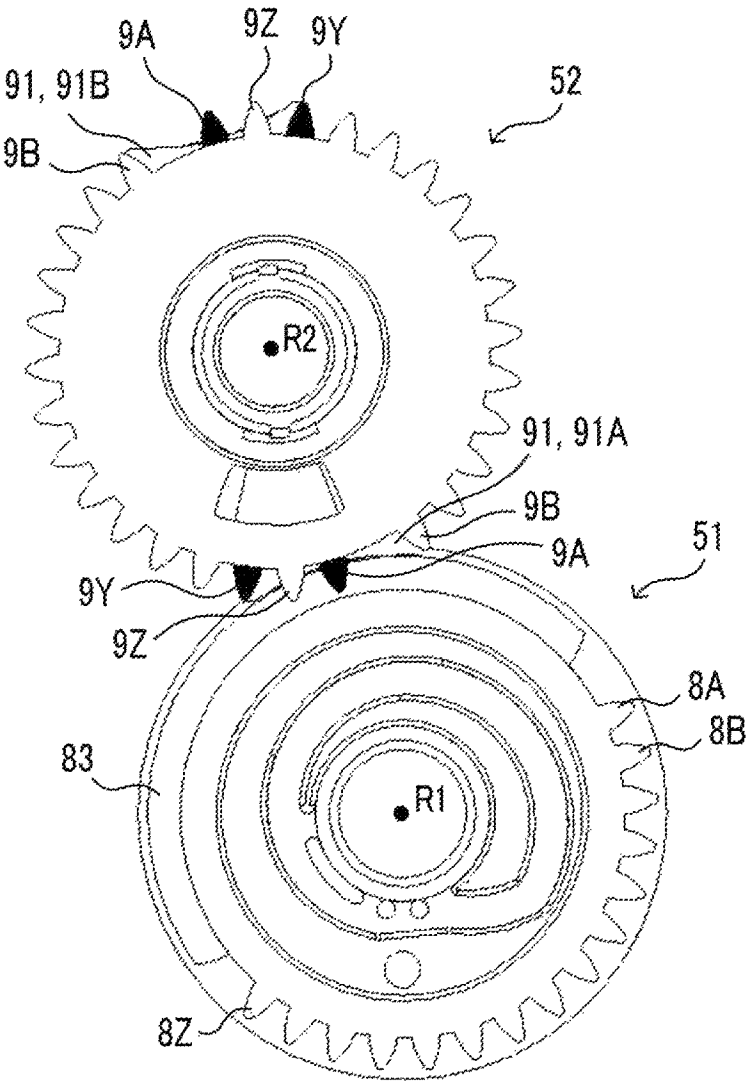

FIG. 8A shows a state before the driving gear 51 starts to rotate. That is, FIG. 8A shows a state where the rotation of the driving gear 51 is restricted by the clutch mechanism. That is, in this state, the engaging portion 531 of the actuators 53 abuts on the stepped portion 54, thereby restricting the rotation of the driving gear 51. At this time, the facing rib 91A of the driven gear 52 is located to face the annular rib 83 of the driving gear 51, thereby restricting the rotation of the driven gear 52, as well. Subsequently, when the engaging portion 531 of the actuators 53 is separated from the stepped portion 54 in response to an input control signal, the driving gear 51 starts to rotate in the rotation direction D5 by the biasing force of the biasing member. At this time, however, since the driven gear 52 is still in the non-meshing state, the driven gear 52 remains to be in the stationary state if the driving gear 51 starts to rotate.

FIG. 8B shows a state immediately after the tooth 8A of the driving gear 51 abuts on the tooth 9A of the driven gear 52. That is, FIG. 8B shows a state immediately after the non-meshing state transitions to the meshing state. The tooth 8A of the driving gear 51 presses the tooth 9A of the driven gear 52, and thereby causes the driven gear 52 to rotate in the rotation direction D6. Subsequently, as shown in FIG. 9A, the teeth 8 of the driving gear 51 mesh with the teeth of the driven gear 52, and the driven gear 52 rotates in response to the rotation of the driving gear 51.

Figure 9B:
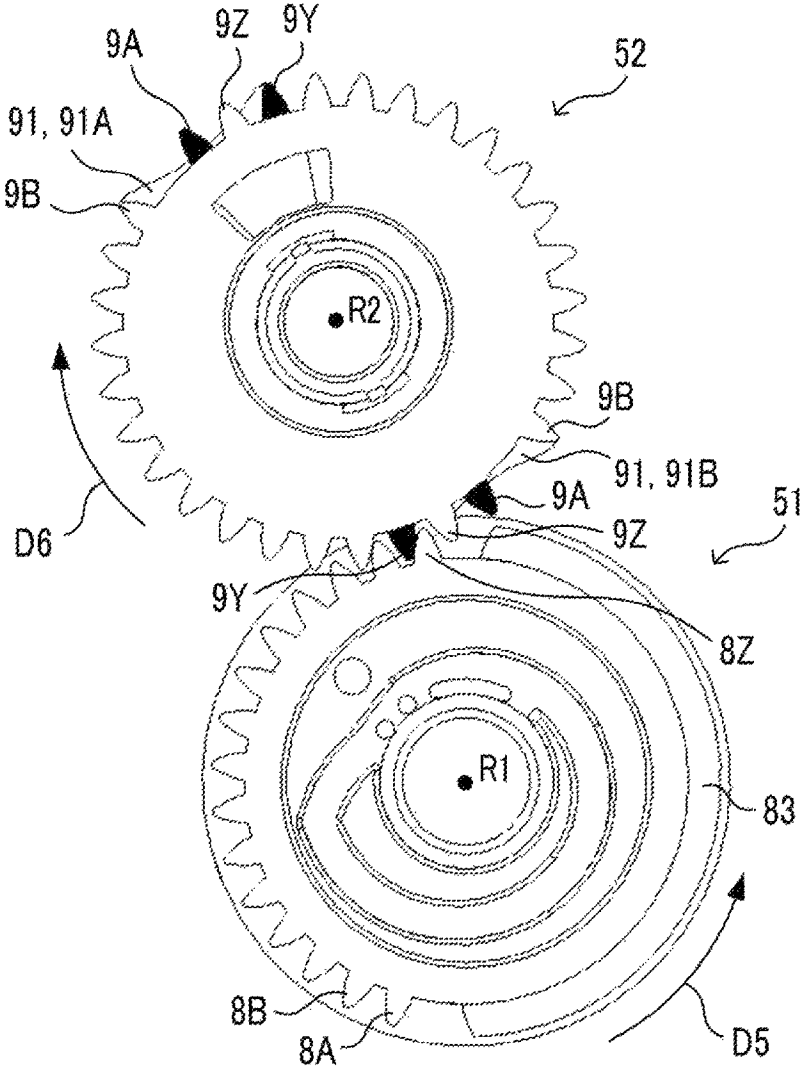
FIG. 9A and FIG. 9B are diagrams showing movement of the driving gear and the driven gear in the image forming apparatus according to the embodiment of the present disclosure.
Figure 9A:
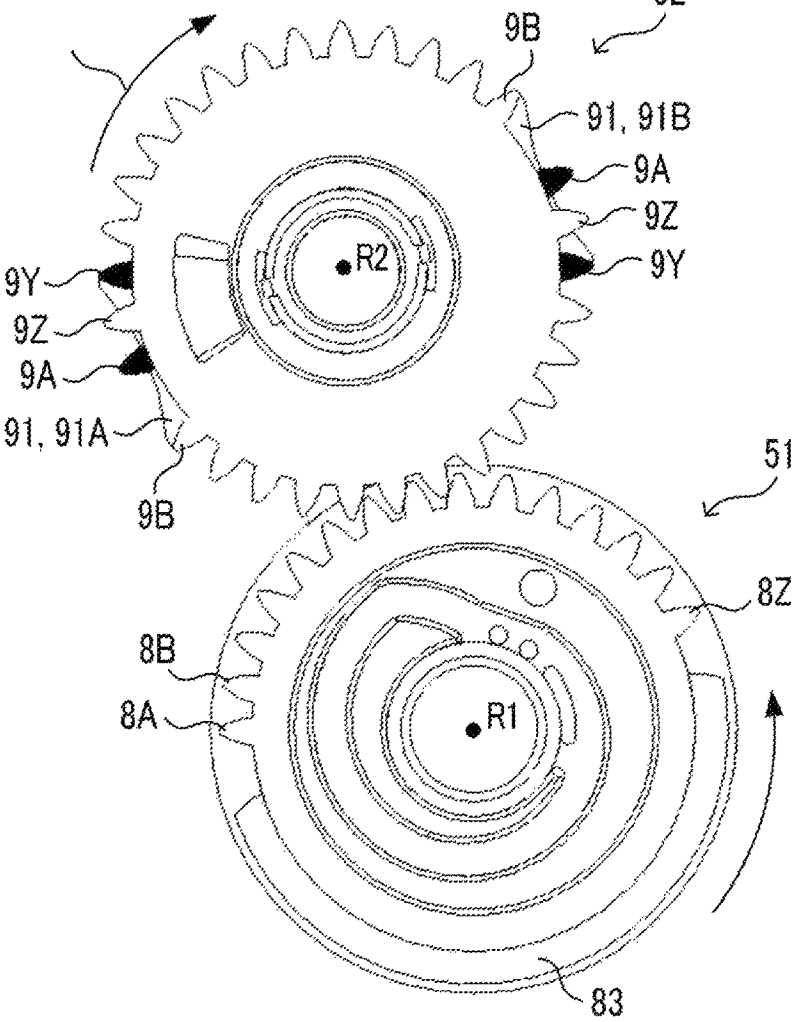

FIG. 9B shows a state where the tooth 8Z of the driving gear 51 abuts on the tooth 9Y of the driven gear 52. FIG. 10A shows a state immediately before the tooth 8Z of the driving gear 51 is separated from the tooth 9Y of the driven gear 52. That is, FIG. 10A shows a state immediately before the meshing state transitions to the non-meshing state. After the tooth 8Z of the driving gear 51 is separated from the tooth 9Y of the driven gear 52, the facing rib 91A of the driven gear 52 is located to face the annular rib 83 of the driving gear 51, thereby restricting the rotation of the driven gear 52. That is, the driven gear 52 remains to be in the stationary state if the driving gear 51 starts to rotate.

Figure 10B:
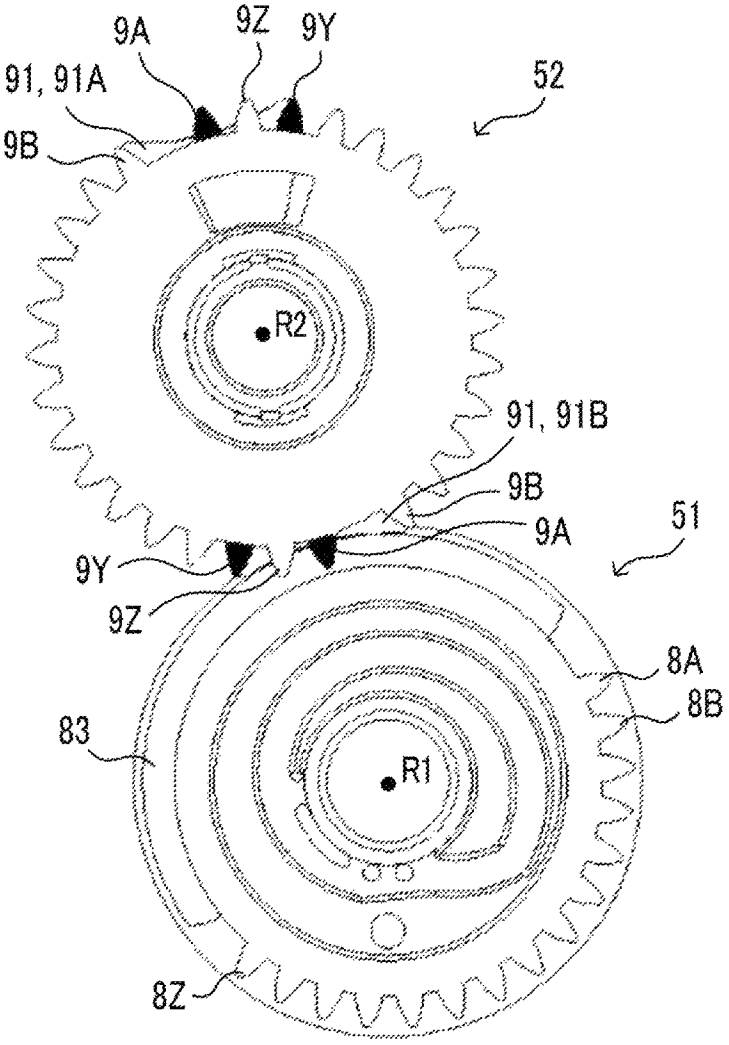
FIG. 10A and FIG. 10B are diagrams showing movement of the driving gear and the driven gear in the image forming apparatus according to the embodiment of the present disclosure.
Figure 10A:
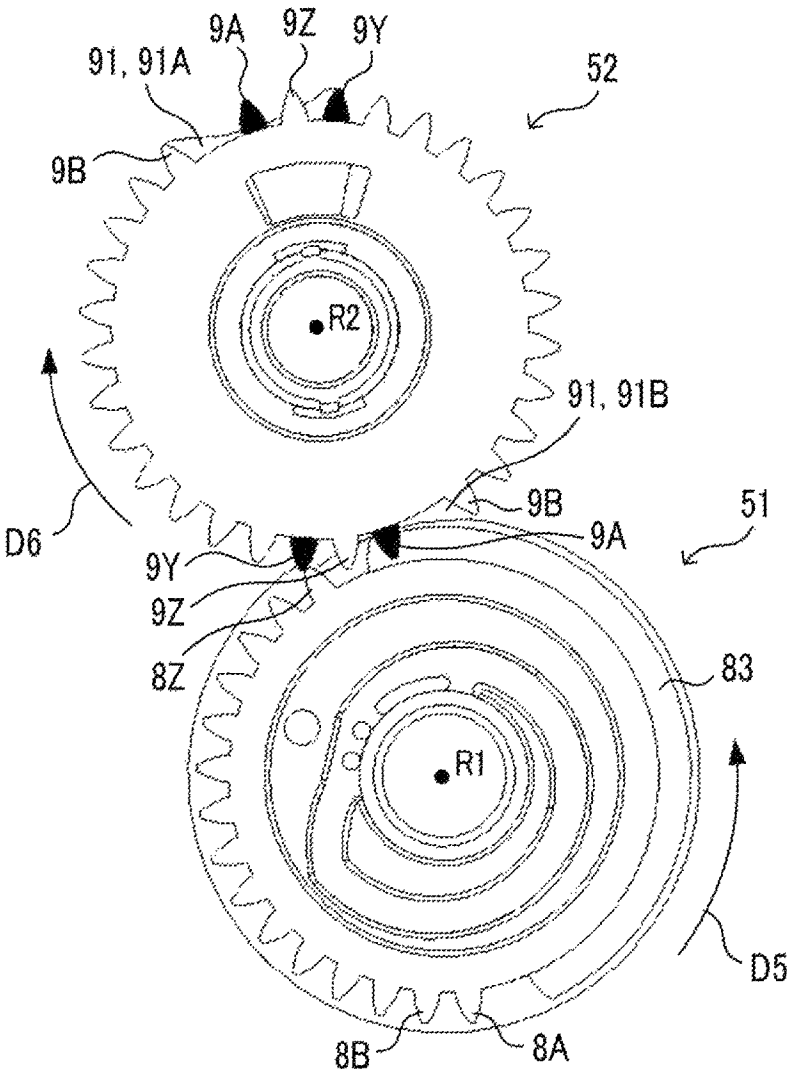

FIG. 10B shows a state after the driving gear 51 ends rotating. That is, FIG. 10B shows a state where the rotation of the driving gear 51 is restricted by the clutch mechanism. That is, in this state, the engaging portion 531 of the actuators 53 abuts on the stepped portion 54, thereby restricting the rotation of the driving gear 51. At this time, the facing rib 91B of the driven gear 52 is located to face the annular rib 83 of the driving gear 51, thereby restricting the rotation of the driven gear 52, as well.

After the state shown in FIG. 10B, when the engaging portion 531 of the actuators 53 is separated from the stepped portion 54 in response to an input control signal, the driving gear 51 starts to rotate in the rotation direction D5 by the biasing force of the biasing member. At this time, however, since the driven gear 52 is still in the non-meshing state, the driven gear 52 remains to be in the stationary state if the driving gear 51 starts to rotate.

Here, a comparison between FIG. 10B and FIG. 8A indicates that when the driving gear 51 rotates once, the driven gear 52 rotates half. That is, according to the present embodiment, since two facing ribs 91 are provided on the driven gear 52, when the driving gear 51 rotates once, the driven gear 52 rotates half. It is noted that as another embodiment, one facing rib 91 or three or more facing ribs 91 may be provided on the driven gear 52. In general, in a case where N (N is a natural number) facing ribs 91 are provided on the driven gear 52, when the driving gear 51 rotates once, the driven gear 52 rotates one-Nth. In this way, it is possible to change the ratio of the rotation speed of the driven gear 52 to the rotation speed of the driving gear 51 by changing the number of facing ribs 91 provided on the driven gear 52.

As described above, according to the power transmission mechanism 5 of the present embodiment, in the non-meshing state, the rotation of the driven gear 52 is restricted by the rotation restricting mechanism. In addition, when the non-meshing state transitions to the meshing state, the tooth 8A of the driving gear 51 abuts on the tooth 9A of the driven gear 52, without abutting on the tooth 9B of the driven gear 52. As a result, according to the power transmission mechanism 5 of the present embodiment, it is possible to prevent a tip of a tooth 8 of the driving gear 51 from abutting on a tip of a tooth 9 of the driven gear 52.

In addition, in the power transmission mechanism 5 of the present embodiment, an interval between a tooth 9A and a tooth 9B of the driven gear 52 is wider than an interval between teeth 9 that are, starting with the tooth 9B, on the upstream side of the tooth 9A in the rotation direction D6, wherein the tooth 9B is the $2^{nd}$ tooth 9 counted from the tooth 9A toward the upstream side in the rotation direction D6. As a result, according to the power transmission mechanism 5 of the present embodiment, it is possible to restrict a noise from occurring when the non-meshing state transitions to the meshing state. The following describes the reason with reference to FIG. 11A and FIG. 11B.

Figure 11A:
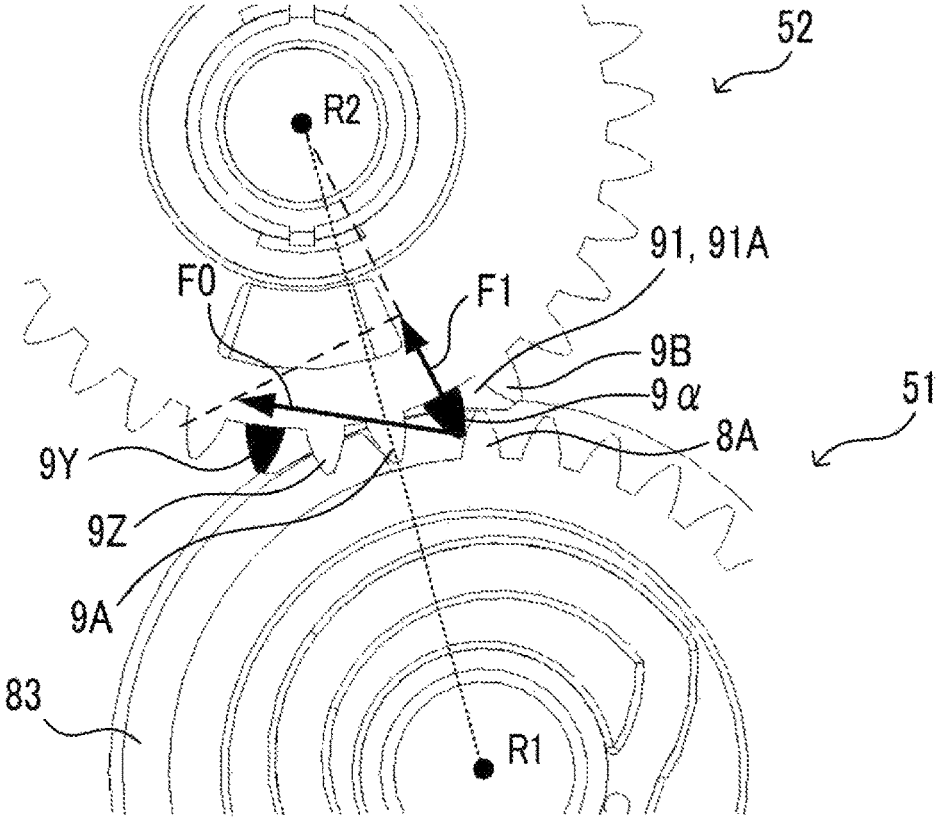
FIG. 11A and FIG. 11B are diagrams showing a force that acts on the driven gear in each of image forming apparatuses of a comparative example and the embodiment of the present disclosure.

FIG. 11A shows a configuration of a comparative example in which a tooth 9*a* is formed between the tooth 9A and the tooth 9B of the driven gear 52. In this case, when the non-meshing state transitions to the meshing state, the tooth 8A of the driving gear 51 abuts on the tooth 9*a* of the driven gear 52. When the tooth 8A of the driving gear 51 abuts on the tooth 9*a* of the driven gear 52, a force F0 acts on the driven gear 52. As a result, a component force F1 of the force F0 acts on the bearing of the driven gear 52.

Figure 11B:
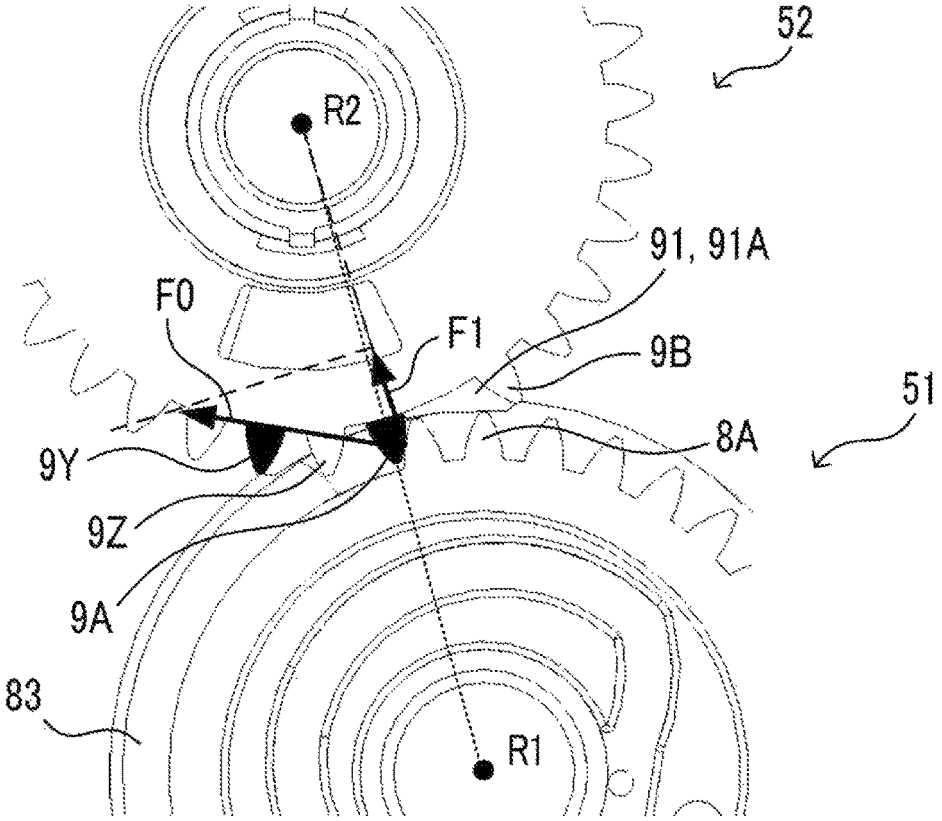

On the other hand, in the power transmission mechanism 5 of the present embodiment, as shown in FIG. 11B, since the interval between the tooth 9A and the tooth 9B of the driven gear 52 is wide, when the non-meshing state transitions to the meshing state, the tooth 8A of the driving gear 51 first abuts on the tooth 9A of the driven gear 52. When the tooth 8A of the driving gear 51 abuts on the tooth 9A of the driven gear 52, a force F0 acts on the driven gear 52. As a result, a component force F1 of the force F0 acts on the bearing of the driven gear 52.

In the power transmission mechanism 5 of the present embodiment, when the non-meshing state transitions to the meshing state, the tooth 8A of the driving gear 51 first abuts on the driven gear 52 at a position that is closer to the plane including the rotation shaft R1 and the rotation shaft R2 than in the comparative example. Accordingly, the component force F1 shown in FIG. 11B is smaller in size than the component force F1 shown in FIG. 11A. As a result, according to the power transmission mechanism 5 of the present embodiment, it is possible to restrict the bearing of the driven gear 52 from generating a noise when the non-meshing state transitions to the meshing state. This also applies to the noise generated by the bearing of the driving gear 51.

As another embodiment, one or more teeth 8 (for example, tooth 8B) among the plurality of teeth 8 formed on the driving gear 51 may be omitted. Similarly, one or more teeth 9 (for example, tooth 9Z) among the plurality of teeth 9 formed on the driven gear 52 may be omitted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A power transmission mechanism comprising:

a driving gear including a teeth portion and a tooth-chipped portion, wherein in the teeth portion, a plurality of teeth are formed along a circumferential direction of the driving gear, and in the tooth chipped portion, no tooth is formed; and a driven gear configured to be intermittently driven transitioning between a meshing state and a non-meshing state as the driving gear rotates, wherein in the meshing state, the driven gear and the driving gear mesh with each other, and in the non-meshing state, the driving gear and the driven gear do not mesh with each other, wherein an interval between a first tooth and a second tooth of the driven gear is wider than an interval between teeth of the driven gear that are, starting with the second tooth, on an upstream side of the first tooth in a rotation direction of the driven gear, wherein the first tooth is a tooth of the driven gear that, when the non-meshing state transitions to the meshing state, abuts on a tooth of the driving gear that is, in the teeth portion, on a most downstream side in a rotation direction of the driving gear, and the second tooth is the second tooth counted from the first tooth toward the upstream side in the rotation direction.

2. The power transmission mechanism according to claim 1, wherein in the non-meshing state, the first tooth intersects a plane that includes a rotation shaft of the driving gear and a rotation shaft of the driven gear.

3. The power transmission mechanism according to claim 1, further comprising:

a rotation restricting mechanism configured to restrict rotation of the driven gear in the non-meshing state.

4. The power transmission mechanism according to claim 3, wherein the rotation restricting mechanism includes:

an annular rib formed along a tooth-chipped portion of the driving gear, the annular rib including an outer circumferential surface having a shape of a circular arc centering on a rotation shaft of the driving gear; and a facing rib formed on the driven gear, the facing rib including an outer circumferential surface having a shape along the outer circumferential surface of the annular rib in the non-meshing state.

5. The power transmission mechanism according to claim 4, wherein the outer circumferential surface of the facing rib is formed to extend from a tip of a tooth of the driven gear to a tip of another tooth of the driven gear.

6. The power transmission mechanism according to claim 4, wherein two or more facing ribs are formed at equal intervals along a circumferential direction of the driven gear.

7. The power transmission mechanism according to claim 1, wherein the driving gear includes a clutch mechanism configured to control rotation of the driving gear in units of circumferences.

8. An image forming apparatus comprising:

a developing device;

a toner supply portion configured to supply toner to the developing device;

a motor; and the power transmission mechanism according to claim 1 configured to transmit a power of the motor to the toner supply portion.

* * * * *